United States Patent [19]

Henneberry

[11] Patent Number: 4,522,551

[45] Date of Patent: Jun. 11, 1985

[54] REFUSE STORAGE AND DISCHARGE APPARATUS

[76] Inventor: James W. Henneberry, 170 Brixton Rd. S., Garden City, N.Y. 11530

[21] Appl. No.: 485,725

[22] Filed: Apr. 18, 1983

[51] Int. Cl.[3] ..... B65F 3/28

[52] U.S. Cl. ..... 414/517; 414/525 R; 91/517

[58] Field of Search ..... 414/517, 525 R; 91/517, 91/518

[56] References Cited

U.S. PATENT DOCUMENTS

| | | | |
|---|---|---|---|
| 3,402,837 | 9/1968 | Palmer et al. | 414/517 |
| 3,410,427 | 11/1968 | McCarthy | 414/517 |
| 3,696,951 | 10/1972 | Toppins et al. | 414/517 |
| 3,884,372 | 5/1975 | Kunii | 414/525 |
| 4,050,594 | 9/1977 | Gollnick | 414/517 |
| 4,065,008 | 12/1977 | Ratledge | 414/525 |
| 4,273,497 | 6/1981 | Mealing et al. | 414/517 |
| 4,371,306 | 2/1983 | Smith | 414/517 X |

*Primary Examiner*—Joseph E. Valenza
*Assistant Examiner*—David A. Bucci

[57] ABSTRACT

Refuse apparatus, e.g. on a vehicle, comprising a container having a multistage telescopic cylinder device connected to an ejector panel, the device being movable from a retracted position at the forward closed end of the container to an extended position spanning the distance to an opening at the rearward end of the container for ejecting stored refuse by the panel, and a compacting piston-cylinder assembly connected to a pushing structure for conveying and compacting refuse into the container via the opening and forwardly against the panel, and a control system for individually controlling the hydraulic actuation of the device and of the assembly, including a device control valve for locking hydraulically the device in extended position, an assembly control valve for moving the assembly forwardly from a rearward initial position to a forward final position for compacting the refuse under increasing hydraulic pressure up to a predetermined threshold pressure, a threshold electrical switch responsive to such predetermined pressure for automatically energizing a dump valve each time such predetermined pressure is reached for discharging fluid from the device to cause its automatic incremental forward movement under the compacting pressure of the assembly and pushing structure until such pressure decreases below the predetermined pressure, and limiting switches positioned for activation by the assembly to limit the electrical energization of the dump valve to the amplitude between the initial and final positions of the assembly independently of the pressure sensed by the threshold switch.

7 Claims, 5 Drawing Figures

Figure 4:
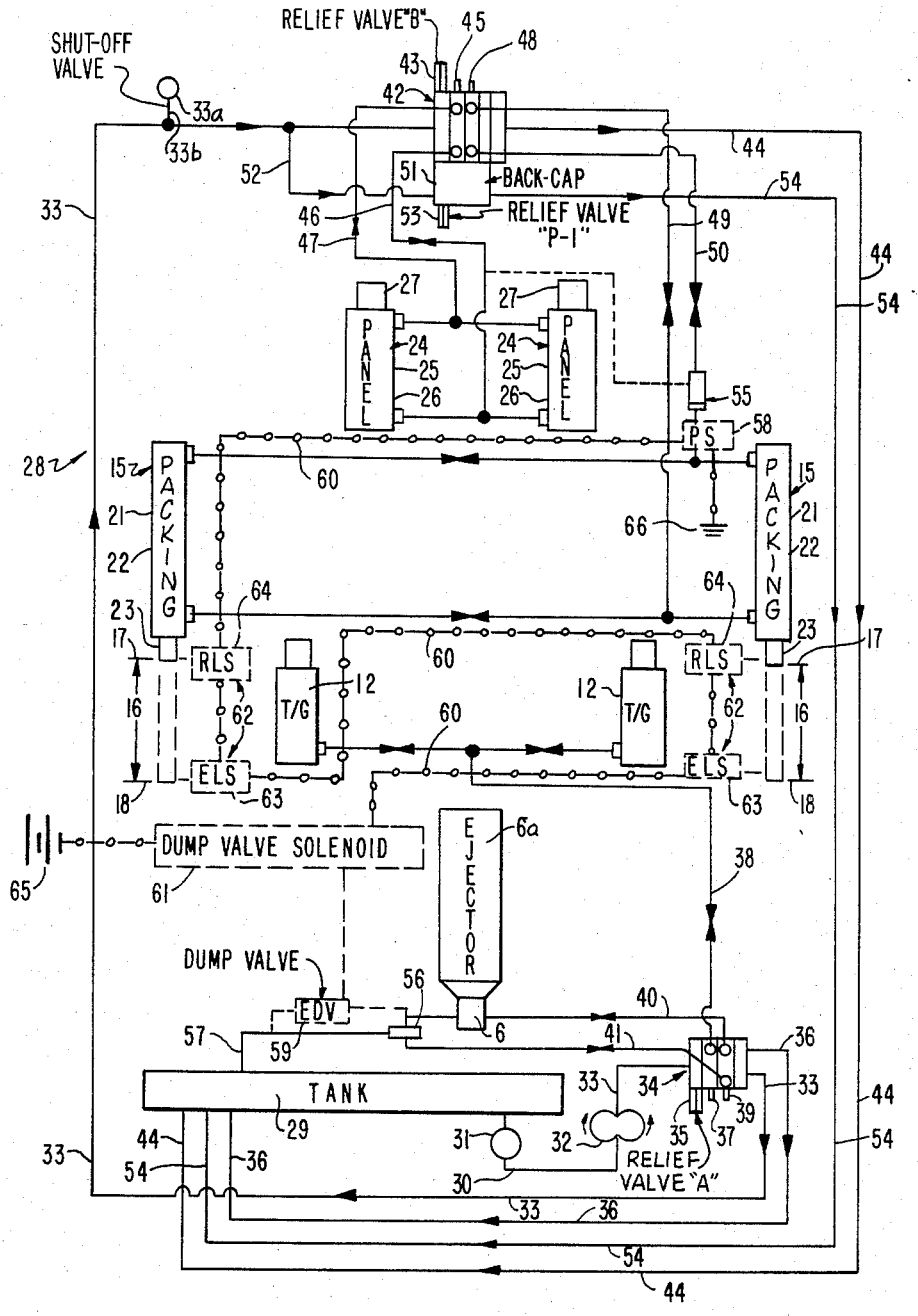

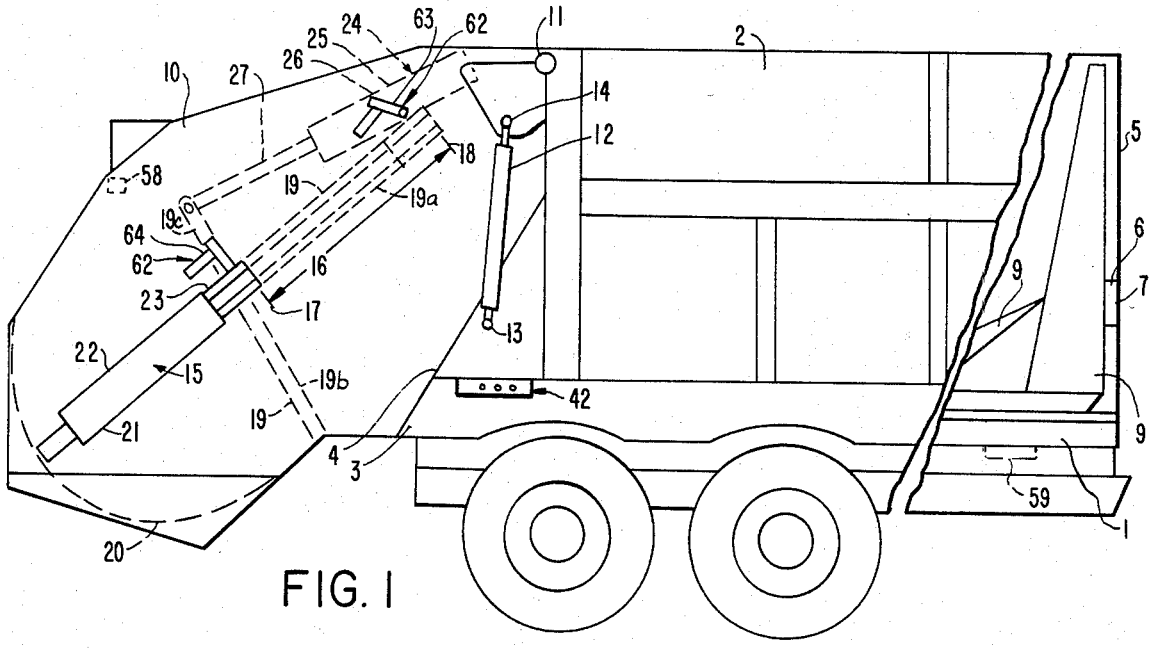
FIG. 1
FIG. 2
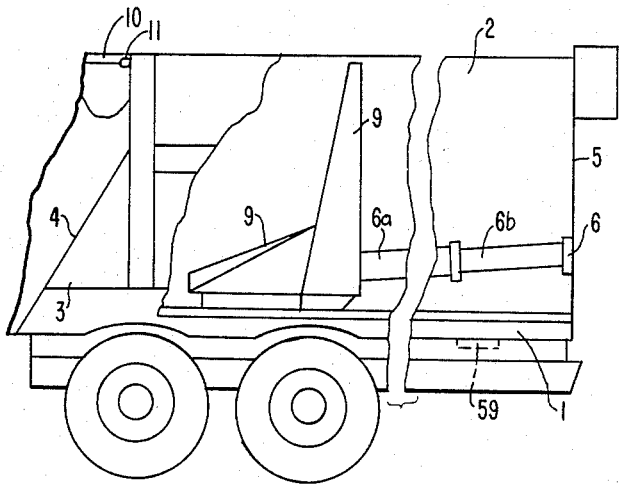
FIG. 3
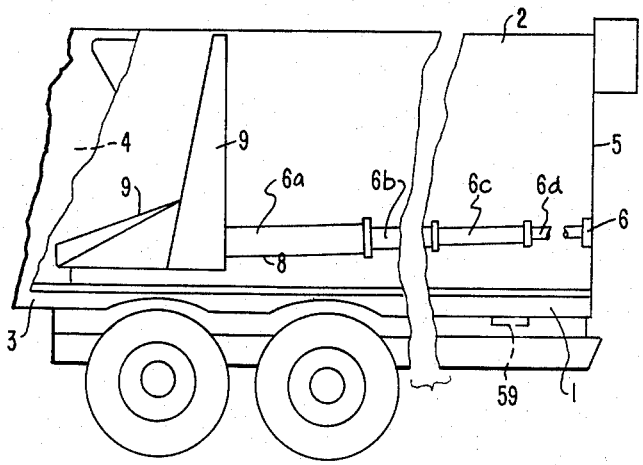

REFUSE STORAGE AND DISCHARGE APPARATUS

The present invention relates to a refuse storage and discharge apparatus, and more particularly to an electrohydraulic system for providing maximum storage of uniformly tightly compacted refuse in a container, such as one mounted on a vehicle and having a rear loading tailgate compacting system.

Many types of refuse collection vehicles containing compacting arrangements are known in the prior art, all of which generally suffer from one or more disadvantages such as high construction, maintenance and/or energy consumption costs, inefficient operation, compacting and/or storage under the controllable pressure conditions, complex control systems, and the like.

Thus, U.S. Pat. No. 3,486,646 (O'Brien et al) concerns an obviously high construction cost refuse vehicle of modified chassis structure, similar to that of a typical London double decker bus, to increase its load capacity size, but otherwise having the usual type of rear loading and compacting member operated via a control system and located in a raisable tailgate for unloading, plus a multistage telescopic cylinder powered ejector panel operated by any suitable and apparently unrelated control system (not shown).

U.S. Pat. No. 3,696,951 (Toppins et al) concerns a rear loader refuse collection vehicle containing a pusher panel and packer plate, in a tailgate, which are powered by hydraulic rams to load the body and compact the loaded refuse against a forwardly yieldable multistage telescopic cylinder powered ejector head, using a separate complex control system for operating the pusher panel and packer plate of the compacting arrangement in the tailgate from the apparently unrelated system (not shown) for operating the telescopic ejector head.

U.S. Pat. No. 3,734,316 (Worthington) concerns a predetermined pressure reverse actuation control valve of complex design which determines when the extended multistage telescopic cylinder and rearwardly facing compacting blade, used to compact refuse apparently directly against the closed rear end of the container on a refuse vehicle, are to be reversed to retract the telescoping cylinder and blade to their forward starting position. No tailgate compacting panel is shown for related use in conjunction with the contemplated arrangement.

U.S. Pat. No. 4,173,424 (Whitehead et al) concerns a front loading refuse vehicle which, instead of using a tailgate compactor in conjunction therewith, provides a front downwardly charging top dump opening in its container and a back discharge door therefor, the opening being charged with separate loads of refuse by a pivoted hopper structure movable via levers from the front of the vehicle over its cab to such opening. A compacting head is disposed in the container which is normally located at a starting position forwardly of the opening, and movable by a multistage telescopic cylinder toward the back door, such head and telescopic cylinder being solely used for compacting each load of refuse directly against the back door and for a time period set by relays in a complex electrical time delay control system which controls the valve used to operate the hydraulic system for the telescopic cylinder. A high pressure limit switch is actuated after the set time period to return the compacting head to its starting position, i.e., between loads, via the valve, whereupon a low pressure limit switch is actuated to permit the cycle to be repeated. The time delay relay circuit of the complex control system is such that sharp pressure drops which occur as various stages of the cylinder are successively actuated during the compacting are prevented from causing the low pressure limit switch to operate prematurely and before the desired timed compacting period has elapsed.

U.S. Pat. No. 4,050,594 (Gollnick) concerns a typical tailgate compacting refuse vehicle using a sequence valve in the hydraulic control system for selective conjoint operation of two sets of hydraulic cylinders used for height control and packing force of a packing plate in the compactor assembly of the tailgate to insure that a predetermined pressure will be maintained in the primary circuit of the height control cylinders before the secondary circuit is energized for operating the larger surface area packing cylinders, during compacting of loaded refuse forwardly against a typical multistage telescopic cylinder powered ejector panel which apparently operates via an unrelated control system.

U.S. Pat. No. 3,999,669, and its parent U.S. Pat. No. 3,899,091, (both to Smith) concern a similar tailgate compacting refuse vehicle in which the predetermined relief valve pressure in the main power line of a packer hydraulic system is used to cause forward movement of a multistage telescopic cylinder powered ejector panel as the packer panel compacts refuse against it, independently of the friction of the refuse against the vehicle container body and of the effective hydraulic pressure at the working surface of the telescopic cylinder which varies with its degree of multistage extension. In effect, a main power line hydraulic system pressure derived control pressure is used to operate a mechanical relief valve for the ejector and its telescopic cylinder set near the maximum system pressure of the power line, but independently of the packer cylinder flow line circuit, also connected to the main power line via its own packer control valve, so that when the packing pressure exceeds the relief valve pressure, the main power line pressure momentarily decreases as the ejector and its telescopic cylinder retract slightly, but since the relief valve is not open very long the packer cylinder does not drop in pressure very far from the maximum pressure in the main power line, with which it is in communication via such control valve, and the packing is able to continue against the so retracted ejector and its telescopic cylinder at the same maximum pressure. The relief valve for the ejector and its telescopic cylinder in such system would appear to be directly influenced by hydraulic spikes and dead headed cylinder pressure experienced by the packer cylinder flow line circuit when such packer control valve is open.

U.S. Pat. No. 3,402,837 (Palmer et al) concerns a tailgate compactor type of refuse vehicle in which a complex electrical time delay control system is used for controlling the packer blade and multistage telescopic cylinder powered ejector panel operation, including limit switches to assure that the dual packer blade mechanisms operate synchronously, and in which the control circuit controls the telescopic cylinder powered ejector panel to operate in forward or retracting direction under a preset time delay relative to the operation of the packer blade and before the packer blade again moves in rearward direction as when an object is jammed in the compacting area or the compacting cycle is to be repeated.

U.S. Pat. No. 3,410,427 (McCarthy) concerns a tailgate compactor type of refuse vehicle including a pressure operated mechanical valve control system in which a pressure sensitive mechanical dump valve or relief valve is directly flow connected in the packer ram hydraulic line and operates under the ram pressure to dump hydraulic fluid from the power stroke line of the hydraulically locked multistage telescopic cylinder connected to the ejector panel, so as to move the ejector panel forwardly as the telescopic cylinder retracts under the compacting force of the packing rams until the ejector panel movement causes the ram pressure to drop sufficiently to close the dump valve or relief valve until the next cycle. Clearly, the dump valve or relief valve for the telescopic cylinder in such system is directly influenced by hydraulic spikes and dead headed cylinder pressure experienced by the packer ram hydraulic line.

U.S. Pat. No. 4,273,497 (Mealing et al) concerns a more recent development of a tailgate compactor type of refuse vehicle in which a multistage telescopic cylinder cantilevered reinforcement is provided in the container to minimize the space occupied by the telescopic cylinder and the ejector head powered thereby while relieving the container of stress at the mounting therein of the telescopic cylinder. The tailgate construction embodies a lower sweeper plate which swivels on the rear end of the upper packer plate via a pair of laterally disposed sweeper rams carried on the packer plate for sweeping refuse from the tailgate hopper into the container, and the packer plate moves along straight line inclined tracks in the sides of the tailgate under the action of a pair of laterally disposed packer rams of larger size than the sweeper rams between a hopper sweeping rearward initial position and a compacting forward final position. Specifically, when the sweeper rams are retracted while the packer plate is in forward final position, the sweeper plate swivels rearwardly and upwardly to a flat position forming an in line extension of the packer plate, and when the packer rams are thereafter extended the packer plate moves rearwardly to the initial position such that the sweeper plate in flat position reaches the rearward edge of the hopper. Next, the sweeper rams may be extended to swivel the sweeper plate forwardly and upwardly to a more or less right angle position relative to the packer plate to push refuse in the hopper forwardly and upwardly and thereafter the packer rams may be retracted to move the packer plate forwardly to the final position once again for compacting the so pushed refuse into the container opening and against the ejector panel which is automatically sequenced forward in stages (by means not shown) to provide substantially uniform compaction of the refuse throughout the container filling process.

Basic problems of the prior art include the fact that the refuse is not uniformly tightly compacted in the refuse container, and that the container is not filled to maximum capacity, except by resort to complex and expensive apparatus elements and control means.

It is among the objects and advantages of the present invention to overcome various drawbacks and deficiencies of the prior art, including those typified by the above noted U.S. patents, and to provide a simple and low cost refuse storage and discharge apparatus, and more particularly an electrohydraulic system for providing maximum storage of uniformly tightly compacted refuse in a container, such as one mounted on a vehicle and having a rear loading tailgate compacting system.

It is among the additional objects and advantages of the present invention to provide an apparatus of the foregoing type, having a hydraulically actuated multistage telescopic cylinder device for powering an ejector panel in the container which moves yieldingly in forward direction under the compacting force of a hydraulic piston-cylinder compacting assembly, in an automatic and incremental manner and only under a predetermined threshold pressure sensed in the hydraulic system of the compacting assembly as the compacting progresses through the stroke amplitude of the assembly for tight control of such automatic movement in dependence upon an electrically operated low energy consumption dump valve which operates only at such threshold pressure for incremental retraction of the telescopic cylinder device and only when the piston-cylinder compacting assembly is within the limits of its stroke amplitude, and completely independently of the number and relative position of the progressively sized individual stages or sections of the telescopic cylinder device.

It is among the further objects and advantages of the present invention to provide an apparatus as stated above, and which is of comparatively low construction, maintenance and energy consumption costs, which is efficient in operation under the controlled pressure conditions, which employs a relatively simple and straightforward electrohydraulic control system, and especially which lends itself to modification of existing equipment for achieving the principal aspects of the instant constructional combination of minimal essential elements for maximum storage of uniformly tightly compacted refuse in the container.

Figure 5:
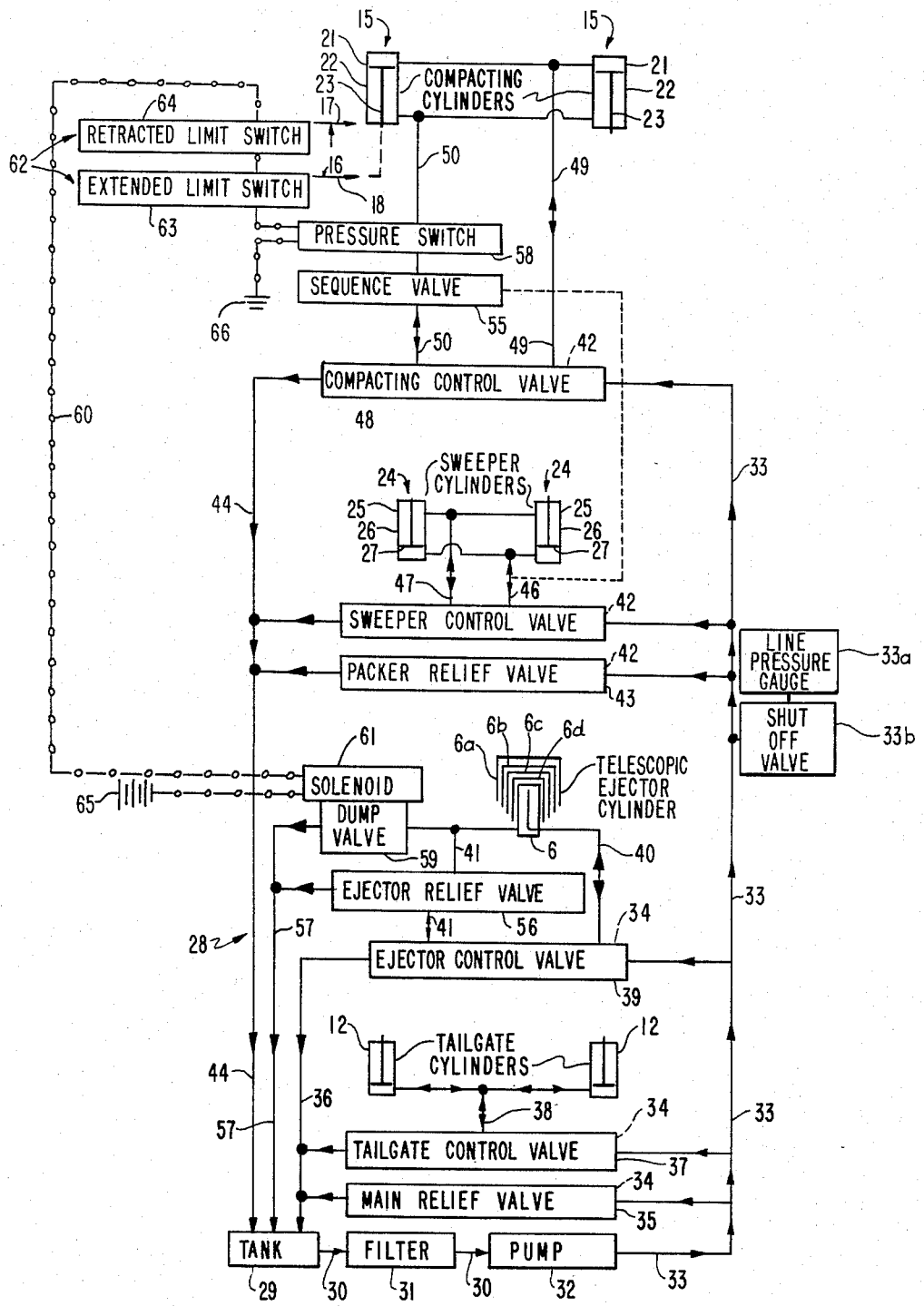

Other and further objects and advantages of the present invention will become apparent from a study of the within specification and accompanying drawings, in which:

FIG. 1 is a schematic side view of a refuse collection vehicle having a container and a tailgate, and embodying the apparatus of the present invention, FIGS. 2 and 3 are schematic partial views similar to FIG. 1 but showing the progressive extension of the hydraulically actuated multistage telescopic ejector cylinder for moving the ejector panel from the forward end of the container to the rearward end thereof, FIG. 4 is a schematic view of the electrohydraulic control system of the present invention as embodied (in phantom) in a modified form of an existing control system for the refuse vehicle, and FIG. 5 is a schematic view similar to FIG. 4, showing the essential electric and hydraulic circuit elements of the control system of the present invention in relation to associated parts, in generally block diagram configuration.

In accordance with the present invention, a refuse storage and discharge apparatus is advantageously provided, comprising a longitudinal refuse collection container having a rearward end defining an opening and a forward end containing a hydraulically actuated multistage telescopic ejector cylinder device longitudinally relatively movable between a retracted position adjacent the forward end and an extended position generally spanning the distance between the forward and rearward ends, plus a hydraulically actuated compacting piston-cylinder assembly disposed rearwardly of the opening and longitudinally relatively movable reciprocally along a stroke path having an amplitude defined between a rearward initial position generally rearwardly of the opening and a forward final position generally adjacent the opening, and specific control means for individually controlling the actuation of the ejector device and of the compacting assembly.

In the usual manner, the ejector device is adapted to be operatively connected to an ejector panel for moving the panel longitudinally rearwardly through the container from the vicinity of the forward end to the vicinity of the rearward end, upon actuating the ejector device from its retracted position to its extended position, for discharging through the opening refuse stored in the container rearwardly of the ejector panel.

Likewise, the compacting assembly is adapted to be operatively connected to refuse pushing means, e.g. a sweeper and packer panel mechanism, for conveying successive refuse portions forwardly into the container and for increasingly compacting each such conveyed refuse portion forwardly against the ejector panel or against the cumulative previously compacted successive refuse portions situated between the pushing means and the ejector panel, upon actuating the compacting assembly to move the assembly along the stroke path from its initial position to its final position.

The specific control means for individually controlling the actuation of the device and of the assembly comprises an electrohydraulic system of operatively interrelated elements, including an ejector device hydraulic fluid circuit, an ejector device actuation control valve, a dump valve, an electric circuit, a compacting assembly hydraulic fluid circuit, a compacting assembly actuation control valve, a threshold electrical switch, and compacting stroke amplitude limiting switch means.

Significantly, the ejector device fluid circuit is adapted to be connected to a pressure source of hydraulic fluid, such as a reservoir fed pump system, and such device fluid circuit contains the device control valve arranged for independent operation to supply hydraulic fluid to the device for moving the device rearwardly to its extended position and to lock hydraulically the device operatively in its extended position under static hydraulic pressure and against discharge of such fluid therefrom and in turn against forward movement of the device toward its retracted position.

The device fluid circuit also contains the dump valve arranged as a normally closed electrically energizable dump valve in the electrical circuit for intermittent energization to open the dump valve, independently of the operation of the device control valve, for intermittent, e.g. momentary, periods of time to discharge incremental amounts of the static pressure fluid from the device to permit in turn concordant incremental forward movement of the device toward its retracted position.

In conjunction therewith, the compacting assembly fluid circuit is adapted to be connected to a pressure source of hydraulic fluid, which advantageously may be the same source as that contemplated for the device fluid circuit, and such assembly fluid circuit contains the assembly control valve arranged for independent operation to supply hydraulic fluid to the assembly for moving the assembly along its stroke path forwardly from its initial position to its final position under an increasing dynamic fluid pressure up to a predetermined threshold operating fluid pressure and in turn for moving the assembly back to its initial position.

The assembly fluid circuit also contains the threshold switch arranged as a normally open, i.e. non-conducting, and temporarily closable hydraulic pressure responsive threshold electrical switch in the electrical circuit for energizing the dump valve and operatively pressure connected to the assembly fluid circuit for sensing the pressure of the fluid supplied to the assembly and for automatically closing the threshold switch temporarily each time the predetermined threshold fluid pressure is reached during forward movement of the assembly toward its final position so as to energize the dump valve for incremental forward movement of the ejector device automatically toward its retracted position under the dynamic pressure of the fluid supplied to the compacting assembly until such pressure decreases to below the predetermined threshold fluid pressure, and thereby permit continued optimum compacting forward movement of the assembly toward its final position.

In complemental connection with the foregoing, the amplitude limiting switch means, e.g. a pair of linearly spaced apart cam actuated microswitches, are arranged as normally closed, i.e. conducting, switch means in the electrical circuit and selectively positioned adjacent the stroke path for operative actuation by the compacting assembly for opening the limiting switch means to limit the electrical energization of the dump valve to the amplitude between the initial position and the final position of the assembly independently of the pressure sensed by the threshold switch.

Desirably, an ejector device relief valve is contained in the device fluid circuit and a compacting assembly relief valve is contained in the assembly fluid circuit for selectively limiting the maximum operating pressure permitted in each of such fluid circuits in excess of the predetermined threshold pressure.

Favorably, the amplitude limiting switch means include an initial position limiting switch at the initial position of the compacting assembly and a final position limiting switch at the final position of the assembly, with the two limiting switches, the threshold switch and the dump valve being operatively connected in series in the electrical circuit.

Thus, the ejector device fluid circuit and the compacting assembly fluid circuit may be conveniently individually connected to a common source of hydraulic fluid including a reservoir or tank and a pump for independently supplying hydraulic fluid under selective pressure to the device control valve and to the assembly control valve.

Moreover, an ejector panel may be operatively connected to the ejector device in the container, and a raisable, e.g. hinged, tailgate having a refuse collection hopper may be provided at the container opening, with such tailgate having the compacting assembly operatively mounted thereon and also having disposed therein a hydraulically actuated sweeping piston-cylinder auxiliary arrangement and refuse pushing means, such as a sweeper and packer hinged panel mechanism, in operative relation to the assembly for conjoint operation therewith for sweeping refuse loaded in the hopper into the container via the auxiliary arrangement and the pushing means and in turn compacting such refuse therein via the compacting assembly and the pushing means.

Advantageously, the storage container and tailgate may be mounted on a vehicle in the usual manner.

In particular, the amplitude limiting switch means, threshhold switch and dump valve, i.e. the solenoid coil or the like thereof, are conveniently connected in series in the electrical circuit.

BASIC APPARATUS

Referring to the drawing, and initially FIGS. 1–3, the rear portion of a motor vehicle 1, i.e. rearwardly of the cab, is shown, which carries a longitudinal refuse collection container 2 having a rearward end 3 generally defining a loading and discharge opening 4 and a forward end 5 which is closed and which contains a hydraulically actuated multistage telescopic cylinder ejector device 6 of the usual type. Such may comprise the conventional garbage truck.

Ejector device 6 is longitudinally relatively movable between a retracted position 7 (FIG. 1) adjacent the forward end 5 and an extended position 8 generally spanning the distance between the forward and rearward ends 5 and 3 of the container 2 (FIG. 3). Device 6 includes a series of for instance four stages or cylinder sections *6a, 6b, 6c* and *6d* in telescoping relation (FIG. 3) and is suitably articulatedly connected to the vehicle 1 in the vicinity of the forward end 5 in the usual way and for the usual purpose by mounting or anchoring means (not shown).

Also, ejector device 6 is operatively connected to a typical ejector panel 9 for moving the panel longitudinally rearwardly through the container 1 from the vicinity of the forward end 5 (FIG. 1) to the vicinity of the rearward end 3 (FIG. 3), upon actuating the device 6 from its retracted position 7 to its extended position 8, for discharging through the opening 4 refuse collected, compacted and stored in the container 2 rearwardly of the ejector panel 9.

A raisable tailgate 10 of the usual type is hingedly connected to the container 2 via the hinge 11 across the rearward end 3 along the top of the opening 4 to close the opening during normal use (FIG. 1). Tailgate 10 is locked to the rearward end 3 by suitable means (not shown) during this time, but may be raised out of the way of the opening 4, as when discharging stored refuse at a dump site, by actuating the pair of tailgate cylinders 12, 12 on each side of the tailgate 10, only the cylinder 12 on the right side of the vehicle 1 being shown in FIG. 1, and which are pivoted at their ends respectively to the rearward end 3 and the tailgate 10 at pivots 13 and 14.

The tailgate cylinders 12 in fact each comprise a hydraulically actuated piston-cylinder arrangement of the conventional type longitudinally relatively movable from a retracted position as shown in FIG. 1 to an extended position for raising the tailgate 10 upwardly about the hinge 11. Because the deadweight of the tailgate 10 is sufficiently large, by suitable use of the hydraulic control valve therefor, when the tailgate 10 is to be lowered, the pistons will automatically retract into the cylinders under such deadweight for discharge of the hydraulic fluid therefrom without the need to actuate the tailgate cylinders 12 under positive reverse flow of hydraulic fluid, as the artisan will appreciate.

A hydraulically actuated compacting piston-cylinder assembly 15 of the usual type is disposed on the tailgate 10 rearwardly of the opening 4. Compacting assembly 15 is longitudinally relatively movable reciprocally along a stroke path 16 having an amplitude defined between a rearward initial position 17 generally rearwardly of the opening 4 and a forward final position 18 generally adjacent the opening 4.

Compacting assembly 15 is operatively connected to refuse pushing means of the usual type such as the sweeper and packer hinged panel mechanism 19 (shown in phantom in FIG. 1) for conveying successive refuse portions or a garbage from the tailgate hopper 20 forwardly into the container 2 and for increasingly compacting each such conveyed refuse portion forwardly against the ejector panel 9 or against the cumulative previously compacted successive refuse portions situated between the panel mechanism 19 and the ejector panel 9 in the usual way, i.e. upon actuating the compacting assembly 15 to move the assembly during each compacting cycle along the stroke path 16 from its initial position 17 to its final position 18.

Compacting assembly 15 in fact comprises a pair of hydraulically actuated packer jacks or rams or cylinders or compacting piston-cylinder mechanisms 21, 21 of the conventional type mounted on each side of the exterior of the tailgate 10, only the mechanism 21 on the right side of the vehicle 1 being shown in FIG. 1.

Each mechanism 21 includes a cylinder 22 and piston 23, with one of such parts, e.g. the cylinder 22, being stationarily fixed to the adjacent side wall of the tailgate 10 and the other of such parts, e.g. the piston 23, being connected to the panel mechanisms 19 for movement therewith along the stroke path 16, reciprocally between the initial position 17 and the final position 18, as the one movable such part reciprocates with respect to the other stationary such part.

Of course, the pistons 23 and cylinders 22 may be longitudinally reversed, and/or may be positioned on each side of the interior of the tailgate 10, as desired.

Generally, a hydraulically actuated sweeping piston-cylinder auxiliary arrangement 24 of the usual type is also provided in the tailgate 10 in operative relation to the compacting assembly 15 for conjoint operation therewith, for sweeping refuse loaded in the hopper 20 into the container 2 via the auxiliary arrangement 24 and the panel mechanism 19 and in turn compacting of such refuse therein via the compacting assembly 15 and the panel mechanism 19 in the normal way.

The panel mechanism 19 in conventional manner generally includes a packer panel **19*a* which travels in parallel tracks (not shown) in the tailgate side walls in the same plane as the stroke path 16, and a sweeper panel 19*b* hinged from the rearward edge of the packer panel 19*a***.

Auxiliary arrangement 24 in fact comprises a pair of hydraulically actuated sweeper jacks or rams or cylinders or sweeper piston-cylinder mechanisms 25, 25 of the conventional type stationarily mounted on each side of the top of the panel mechanism 19, only the mechanism 25 on the right side of the vehicle 1 being shown in FIG. 1 (in phantom).

Each mechanism 25 includes a cylinder 26 and piston 27, with one of such parts, e.g. the cylinder 26, being stationarily fixed to the top side of the packer panel 19a and the other of such parts, e.g. the piston 27, being pivotally connected to a lever system **19*c* fixed to the top side of the sweeper panel 19*b* for pivoting the sweeper panel 19*b*, i.e. about the hinged connection between the panels 19*a* and 19*b*, via the mechanism 25, from a generally upward or flat position in line with the packer panel 19*a* and the plane of the stroke path 16 to a generally downward or right angular position (shown in phantom in FIG. 1**).

In this way, upon actuating the compacting assembly 15 to move the panel mechanism 19 to the initial position 17 when the auxiliary arrangement 24 has been actuated to retract the piston 27 into the cylinder 26 of each mechanism 25 to raise the sweeper panel 19*b* to flat position, the panel 19*b* will be positioned at the rearward portion of the tailgate hopper 20 and be ready to convey and compact a load of refuse in the hopper.

Next, upon actuating the auxiliary arrangement 24 to extend the piston 27 from the cylinder 26 of each mechanism 21, the sweeper panel 19*b* will be pivoted to a downward or right angular position and at the same time will sweep such refuse from the tailgate hopper 20 forwardly and upwardly through the opening 4 and into the container 2 under the force of the auxiliary arrangement 24.

When this has been accomplished, the compacting assembly 15 may be actuated to move the packer panel 19*a* along the parallel tracks and in the plane of the stroke path 16. During this time the sweeper panel 19*b* will urge the refuse forwardly, and under the combined action of the packer panel 19*a* and the sweeper panel 19*b* hingedly connected thereto such refuse will be compacted against the ejector panel 9 in the conventional manner.

Of course, the piston 27 must remain extended from the cylinder 26 of each mechanism 25 during this step, even though it is subjected to the counterforce of the compacting assembly 15, and more specifically of the piston-cylinder mechanisms 21, 21 thereof, acting indirectly thereon through the agency of the refuse being compacted against the ejector panel 9 under the oppositely directly force component of the telescopic cylinder ejector device 6.

Should an obstruction cause a jam during the above sequence of steps, the sequence may be reversed in conventional manner to permit the obstruction to be dislodged.

For example, a sequence valve of the usual type may be provided in the power line of the compacting assembly hydraulic fluid circuit so as to divert hydraulic fluid to the pistoncylinder mechanisms 25, 25 sufficiently to cause the sweeper panel 19*b* to be temporarily pivoted back to its upward or flat position in line with the packer panel 19*a* for clearing the obstruction.

Such sequence valve may also be provided so as to insure that the power line of the compacting assembly hydraulic fluid circuit will selectively and preferentially maintain continuously a predetermined pressure in the piston-cylinder mechanisms 25, 25 sufficiently for maintaining in turn the sweeper panel 19*b* in its downward or right angular position before the compacting power actuation of the piston-cylinder mechanisms 21, 21 is effected as well as throughout the duration of such compacting actuation.

As a consequence of such compacting operation, it is intended that the ejector panel 9 will yield in forward direction under a controllable discharge of hydraulic fluid from the multistage telescopic cylinder ejector device 6.

For this purpose, and unlike the present invention, conventionally a back pack valve or ejector relief valve is provided in the ejector device hydraulic fluid circuit which is set to open at a predetermined pressure roughly corresponding to the resultant force of the compacting assembly 15 acting through the interposed refuse and the ejector panel 9 on the telescopic cylinder sections 6*a* to 6*d* of the ejector device 6 and indirectly sensed by such sections.

However, since the individual sections 6*a* to 6*d* of the telescopic cylinder ejector device 6 are of progressively decreasing piston working surface area size due to their inherently decreasing diameters consonant with their telescoping nature, the resultant force of the compacting assembly 15 indirectly sensed by the telescopic cylinder sections will vary in direct dependence upon the degree of extension (or retraction) of the ejector device 6 and in turn upon the particular piston working surface area size of the individual section indirectly sensing such resultant force and transmitting such sensed force to the conventional back pack valve or ejector relief valve.

This may be appreciated from the hydraulic flow control system 28 shown in FIG. 4 which is of existing conventional design and which lends itself to efficient, low cost and minimum modification, as shown in phantom, for providing the combination apparatus of the present invention.

The hydraulic flow control system 28 includes a reservoir or tank 29 for supplying hydraulic pressure fluid via suction line 30, preferably containing a strainer or filter 31 for the usual purposes, to a pump 32, which may be powered by the ignition system of the vehicle 1 or by a takeoff from the motor drive system of the vehicle (not shown), or by any other means, in conventional manner, for supplying hydraulic fluid under main line pressure via hydraulic power line 33 to the composite main control valve 34, as the artisan will appreciate.

Main control valve 34 is of conventional design and includes a main safety relief valve 35 set to operate automatically at maximum permitted operating system pressure in power line 33 for recycling the power fluid to the tank 29 via the main return line 36, a manually operated tailgate cylinder control valve 37 for supplying the power fluid to and discharging the spent fluid from the tailgate cylinder 12 via the tailgate branch line 38, and a manually operated ejector device control valve 39 for supplying the power fluid to and discharging the spent fluid from the multistage telescopic cylinder ejector device 6 via the ejector device fluid circuit bilateral branch lines 40 and 41.

Hydraulic fluid supplied to main control valve 34 via power line 33 is also fed directly to the separate composite packer system control valve 42, normally disposed in the tailgate 10 (see FIG. 1), via the continuation of power line 33 extending to the rearward end of the vehicle 1, i.e. continuously under the main line hydraulic pressure existing in the continuation of power line 33.

Packer control valve 42 is likewise of conventional design and includes a packer relief valve 43 set to operate automatically at a predetermined maximum permitted packer system pressure, i.e. relative to and selectively slightly below the maximum permitted operating system pressure of the main safety relief valve 35 of main control valve 34, for recycling the power fluid from the continuation of power line 33 to the tank 29 via the packer return line 44.

Packer control valve 42 also includes a manually operated, yet preferably automatically sequentially actuated sweeper panel mechanism control valve 45 for supplying the power fluid to and discharging the spent fluid from the cylinders 26, 26 of the piston-cylinder mechanisms 25, 25 of the auxiliary arrangement 24, via the auxiliary arrangement fluid circuit bilateral branch lines 46 and 47, and conjointly actuated compacting mechanism control valve 48 for supplying the power fluid to and discharging the spent fluid from the cylinders 22, 22 of the piston-cylinder mechanisms 21, 21 of the compacting assembly 15, via the compacting assembly fluid circuit bilateral branch lines 49 and 50.

Packer control valve 42 may also include a back cap valve mechanism 51 fed via a branch line 52 and containing a back cap relief valve 53 for recycling the power fluid from the continuation of power line 33 upstream of the packer control valve 42 via the back cap mechanism 51 and the back cap return line 54 to the tank 29, for the usual purposes in conjunction with the operation of the auxiliary arrangement 24 and the compacting assembly 15.

In this regard, it will be seen that a sequence valve 55 may be advantageously included in the compacting assembly power branch line 50, e.g. for operative connection with the auxiliary arrangement power branch line 46 in conventional manner to insure that the sweeper panel mechanism cylinders 26, 26, even though locked hydraulically in extended position (see FIG. 1) via the sweeper control valve 45 when in closed or neutral position, will be maintained in extended position under the line pressure of the fluid in the continuation of power line 33, despite the force in the packing cylinders 22, 22 of the compacting assembly 15 tending to cause the sweeper pistons 27, 27 to retract into the cylinders 26, 26 when the compacting mechanism control valve 48 is in open position for compacting refuse.

The foregoing control valve systems are all well known and used in the normal manner for operating the various elements in the apparatus.

Typically, the packer control valve 42 and the ejector device control valve 39 will remain in closed position when the tailgate cylinder control valve 37 is used, the packer control valve 42 and the tailgate cylinder control valve 37 will remain in closed position when the ejector device control valve 39 is used, and the ejector device control valve 39 and the tailgate cylinder control valve 37 will remain in the closed position when the packer control valve is used.

Hence, these control valves 37, 39 and 42 are arranged for individual and independent operation of the piston-cylinder means controlled thereby.

Generally, the main control valve 34 will be located in the body of the vehicle 1 while the packer control valve 42 will be located on the tailgate (see FIG. 1). The power line 33 may also contain the usual line pressure gauge 33*a* and conjoint shut off valve 33*b*, as desired (see FIG. 4).

In normal operation, upon unlocking the tailgate 10, the tailgate cylinder control valve 37 may be actuated manually to open power position to feed fluid via branch line 38 to the tailgate cylinders 12, 12 to raise the tailgate 10, e.g. for discharging a load of compacted refuse stored in the container 2 through the opening 4. When the tailgate 10 is fully raised, the control valve 37 may be moved back to closed or hydraulically locked neutral position, either automatically under sensed deadheaded cylinder pressure by conventional means (not shown), or manually upon the automatic opening of the relief valve 35 when fluid can no longer be added to the fully extended tailgate cylinder arrangement.

When the tailgate 10 is again to be lowered, the tailgate cylinder control valve 37 may be actuated manually to discharge position temporarily from its closed or neutral position, to permit reverse flow of the fluid via branch line 38 and the main return line 36 back to the tank 29 under the deadweight of the tailgate 10 which serves to squeeze the fluid from the tailgate cylinders 12.

Hence, the tailgate cylinders 12 are actually single acting cylinders since they are only powered in one direction and, simply return in the opposition direction under the force of the deadweight of the tailgate 10, whereupon the tailgate 10 can again be locked to the container 2.

When the container is loaded with compacted refuse which is to be discharged, e.g. at a dump site, and after the tailgate 10 has been unlocked and raised, the ejector device control valve 39 may be actuated manually to and open or power extending position to feed fluid via the branch line 40 to the main working surface faces of now retracted sections 6*a* to 6*d* of the multistage telescopic cylinder ejector device 6 to move successively the sections 6*a* to 6*d* rearwardly to extended position 8 and in turn cause the ejector panel 9 to eject the refuse progressively through the, now tailgate unobstructed, opening 2.

When the ejector device 6 reaches its fully extended position 8, the control valve 39 may be moved back to closed or hydraulically locked neutral position, either automatically under sensed deadheaded cylinder pressure by conventional means (not shown), or manually upon the automatic opening of the relief valve 35 when fluid can no longer be added to the fully extended telescopic cylinder sections 6*a* to 6*d* of the ejector device 6.

Upon manually actuating the ejector device control valve 39 thereafter to open power retracting position to feed fluid via the branch line 41 operatively to the opposite faces of the sections 6*a* to 6*d*, the reverse operation may be carried out to retract successively the sections 6*a* to 6*d* back to fully retracted position 7 and in turn move the ejector panel 9 to its forwardmost position adjacent the forward end 5 of the container 2. At this point, the control valve 39 may be moved back to closed or neutral position as noted above.

Hence, unlike the tailgate cylinders 12, the telescopic cylinder ejector device 6 may be constituted as double acting cylinders or piston-cylinder means since they may be positively powered in both the extending and retracting directions under the force of the hydraulic fluid in the main power line 33.

However, this will not normally be the case since under actual operating conditions, once the ejector device 6 has been moved to extended position 8, it will remain thereat during subsequent loading and compacting operations for incremental retraction under the power stroke compacting force of the compacting assembly 15 until it again reaches the retracted position 7 and/or cannot be further retracted, signifying that the container 2 is once more filled with compacted refuse to the extent possible and thus is ready for refuse ejection at the dump site.

While the ejector device control valve 39 during this repeated loading and compacting time will normally be maintained in closed or hydraulically locked neutral position, i.e. such that the hydraulic fluid contained in the individual sections 6*a* to 6*d* of the telescopic cylinder ejector device 6 will be in static pressure condition, in order to accomplish as foresaid the progressive incremental return of the ejector device 6 hopefully completely back to its retracted position 7 under the compacting force of the compacting assembly 15, a hydraulic pressure operated mechanical back pack valve or ejector relief valve 56 and a conjoint relief ejector return line 57 are conventionally contained in the branch line 41 in temporarily openable flow communication with the tank 29 (FIG. 4).

The ejector relief valve 56 functions like the other relief valves 35, 43 and 53, i.e. generally as a mechanical valve responsive to hydraulic pressure in the flow line that it serves, and is adjustable like each of such other relief valves to actuate automatically to open the relief valve when the fluid in the particular flow line reaches a specific predetermined pressure. Thus, upon reaching a predetermined pressure in the hydraulically locked ejector device 6 due to the compacting force exerted thereon by the compacting assembly 15 indirectly through the agency of the intervening refuse, the ejector relief valve 56 will open to discharge fluid via the branch line 41, the relief valve 56 and the ejector return line 57 back to the tank 29.

With regard to the packer control valve 42, when the ejector device 6 is in its extended position 8 and its control valve 39 is in closed or hydraulically locked neutral position and ready for compacting refuse loaded in the hopper 20, the sweeper control valve 45 may be actuated manually to open power retracting position to retract the pistons 27 into the cylinders 26 carried on the packer panel 19*a* and thereby raise the sweeper panel 19*b* to flat position in line behind the packer panel 19*a* from the position shown in FIG. 1, i.e. when the pistons 23 of the compacting assembly 15 are at the final position 18 consequent the carrying out of a previous compacting operation cycle.

When the sweeper panel 19*b* has been fully raised, the sweeper control valve 45 may be moved back to closed or hydraulically locked neutral position, either automatically or manually under the same conditions as earlier described, and in turn the compacting control valve 48 correspondingly actuated to open power retracting position to retract the pistons 23 into the cylinders 22 fixed to the sidewalls of the tailgate 10.

This will cause the packer panel 19*a* to move downwardly and rearwardly in line with the stroke path 16, until the pistons 23 have rearwardly travelled the linear distance from the final position 18 to the initial position 17, whereupon the compacting control valve 48 may be moved back to closed or hydraulically locked neutral position, either automatically or manually under the same earlier described conditions.

Next, at such initial position 17, the sweeper control valve 45 may be actuated manually to open power extending position to extend the pistons 27 from the cylinders 26 and thereby lower the sweeper panel 19*b* to a right angular position relative to the packer panel 19*a* for sweeping the refuse from the hopper 20 into the container 2. When the sweeper panel 19*b* has been fully lowered, the sweeper control valve 45 may be moved back to closed or hydraulically locked neutral position, either automatically or manually, as before, and in turn the compacting control valve 48 correspondingly actuated to open power extending position to extend the pistons 23 from the cylinders 22.

This will cause the packer panel 19*a* to move upwardly and forwardly in line with the stroke path 16, until the pistons 23 have forwardly retravelled the linear distance from the initial position 17 to the final position 18, whereupon the compacting control valve 48 may be moved back to closed or hydraulically locked neutral position, either automatically or manually as before.

During this latter retravel of the pistons 23 through the amplitude or linear distance along the stroke path 16 between the initial position 17 and the final position 18, the refuse being compacted by the compacting assembly 15 will transmit the force of the pistons 23 against the ejector panel 9 and in turn the hydraulically locked telescopic cylinder ejector device 6, automatically causing the ejector relief valve 56 to open intermittently to relieve the pressure in the ejector device 6.

This will result in the corresponding incremental automatic retraction of the ejector device 6 and the ejector panel 9, followed by the further compacting of the refuse by the compacting assembly 15 during the remainder of its power stroke until the pistons 23 reach their outer limits of extension at the final position 18.

It will be seen that the conjointly functioning piston-cylinder mechanisms 21 and 25 operate as reciprocal packer jacks or cylinders or rams, or double acting cylinder or piston-cylinder means, or the like, in that they may be positively powered in both their respective extending and retracting directions under the alternately supplied force of the hydraulic fluid in the continuation of the main power line 33.

While the foregoing described action is intended for efficient operation to the full limits of the retraction of the ejector device 6 for complete longitudinal loading and compacting of refuse within the container 2, in fact it has been found that such above described conventional system does not operate in actual practice as so intended. Despite the many control valves, including their various relief valves, and especially the back pack valve or ejector relief valve 56, complete longitudinal loading and uniform compacting of refuse within the container 2 does not occur.

This is because in such conventional control system, the individual successive stages or sections 6*a* to 6*d* of the multistage telescopic cylinder ejector device 6 cause individually different pressures to be exerted successively in the branch line 41 leading to the back pack valve or ejector relief valve 56, depending upon the stage of extension (or retraction) of the ejector device 6.

Specifically, where four different sections 6*a* to 6*d* are contained in the ejector device 6, as compared to the single or constant magnitude of the force produced by the compacting assembly 15 and acting through the agency of the intervening refuse onto the ejector panel 9 as such a constant force, four different forces will be exerted via such sections 6*a* to 6*d* on the back pack valve or ejector relief valve 56 in direct dependence upon the diameter of the particular section involved.

Since the piston working surface area size of each of the sections 6*a* to 6*d* changes directly with the diameter of the particular section, and since such working surface area will decrease in steps or stages with the progressive retraction of the telescopic cylinder ejector device 6, the corresponding pressure exerted on the back pack valve or ejector relief valve 56 will not be uniform or constant, but will decrease stepwise among four individual pressures as the sections 6*a* to 6*d* successively retract. However, the back pack valve or ejector relief valve 56 necessarily can have only one automatic setting for practical functioning during the compacting operation.

Consequently, in conventional practice the back pack valve or ejector relief valve 56 is generally set at a predetermined pressure response level which amounts to a compromise among such four stepwise individual pressures represented by the four sections 6*a* to 6*d*, i.e.

a pressure level below that corresponding to the first two stages or sections and above that corresponding to the remaining two stages or sections.

This unfortunately allows the ejector panel 9 to move forwardly in the container 2 during the compacting operation, either too fast in regard to the first two stages or sections, or not at all in regard to the remaining two stages or sections.

As a result, the refuse is not subjected to the full available compacting force during its compacting by the compacting assembly 15 and the compacting thereof is non-uniform and incomplete in regard to such first two stages or sections. Moreover, since the ejector panel 9 may not move at all in regard to such remaining two stages or sections, the amount of refuse actually able to be loaded and compacted in the container 2 will be significantly less than the potential maximum longitudinal capacity of the container 2.

Since the workmen will not normally be trained to perform unsupervised spontaneous manual modifying operations in the field for ongoing adjustment and compensation of the various valves to assure more complete use of the system, the problem is not readily correctable using existing equipment of the foregoing type.

INVENTION MODIFICATION

By way of the present invention, suitable simple one time modification of the foregoing conventional type apparatus and control system is efficiently provided, a net result of which is to maintain a more or less uniform or constant force on the ejector panel 9 by the ejector device 6 during the power stroke compacting operation via the compacting assembly 15 and as the multistage telescopic cylinder ejector device 6 is progressively retracted more or less uniformly or at constant rate from its fully extended position 8 to its full retracted position 7 through the successively retracting stages or sections 6*a* to 6*d* or the like.

Stated another way, the present invention provides for maintaining a constant hydraulic force or counterforce in the multistage telescopic cylinder ejector device 6 throughout the power stroke compacting operation by the compacting assembly 15, and in any position of such assembly 15 within its range of amplitude along the stroke path 16 between the initial position 17 and the final position 18, and in any relative position of the various multiple stages or sections of the ejector device 6 between the fully extended position 8 and the fully retracted position 7 and irrespective of the number of the progressively sized individual stages or sections in the ejector device 6.

In this regard, the hydraulic flow system and control valve and relief valve system as shown in FIG. 4 may be modified (in phantom) by incorporating a threshold pressure responsive electrical switch such as a normally open and non-conducting pressure switch 58 (PS) in the compacting assembly hydraulic fluid circuit branch line 50, downstream of any sequence valve 55 or the like, i.e. in a direction towards the corresponding cylinders 22, 22 of the piston-cylinder mechanisms 21, 21 of the compacting assembly 15; by also incorporating an electrically operated and normally closed ejector hydraulic dump valve 59 (EDV) in the conjoint relief ejector return line 57 in place of or in optional addition to the conventional hydraulic pressure operated mechanical back pack valve or ejector relief valve 56; and by operatively connecting the pressure switch 58 and electric dump valve 59 in an energizable electric circuit 60 which contains a dump valve solenoid 61 or the like of low energy consumption, for operating the dump valve 59 via its solenoid coil in the usual way, to open the dump valve 59 temporarily and intermittently upon pressure responsive temporary and intermittent closing of the threshold switch 58, and which also contains amplitude limiting switch means 62 arranged as normally closed and thus normally conducting switch means and selectively positioned adjacent the stroke path 16 (see FIGS. 1 and 4).

The amplitude switch means 62 are arranged to assure that the threshold switch 58 only opens the dump valve 59 during the time the pistons 23 are still moving along the stroke path 16, and specifically before they reach the final position 18, so that the telescopic cylinder ejector device 6 and the ejector panel 9 will only move toward the retracted position 7 while the pistons 23 continue to exert their moving force on the intervening refuse.

Favorably, the amplitude limiting switch means 62 may include a final position switch means such as an extended position limit switch 63 (ELS) at the final position 18 of the compacting assembly 15 and an initial position switch means such as a retracted position limit switch 64 (RLS) at the initial position 17 of the compacting assembly 15, i.e. relative to the stroke path 16 (FIGS. 1 and 4).

These limit switches 63 and 64 may be provided as conventional piston cam actuated microswitches, e.g. positioned adjacent the pistons 23 on the exterior of the tailgate 10 (FIG. 1).

The limit switches 63 and 64, the threshold electrical switch 58 and the electrically operated dump valve 59, i.e. via its inherently low energy consumption solenoid 61, are conveniently operatively connected in series in the electrical circuit 60. The electrical circuit 60 may be energized in any appropriate manner such as by connection of one pole thereof with the ignition system or storage battery 65 of the vehicle 1 and the other pole thereof to ground 66, e.g. as constituted by the body of the vehicle 1.

The electrical circuit 60 will be energized when the electrical switch 58 is automatically closed at its threshold pressure, so as to energize the dump valve solenoid 61, but only when the pistons 23 are within the stroke path limits and thus do not automatically open the switches 63 or 64 which independently and individually deenergize the electrical circuit 60.

It will be seen that the dump valve 59 is arranged as a normally closed electrically energizable dump valve in the electrical circuit 60 for intermittent energization to open the dump valve, independently of the operation of the ejector device control valve 39, for intermittent periods of time to discharge, e.g. at uniform or constant discharge flow rate, incremental amounts of the static pressure fluid from the otherwise hydraulically locked ejector device 6, to permit in turn concordant incremental more or less uniform or constant speed forward movement of the ejector device 6 toward its retracted position 7, under the generally constant force exerted thereon indirectly by the power stroke compacting operation of the compacting assembly 15, both independently of the moving position of the pistons 23 of the compacting mechanisms 21 along, i.e. within, the stroke path 16, and independently of the number and relative positions of the progressively sized individual stages or sections of the ejector device 6, i.e. independently of the degree of extension or retraction of the ejector device 6 between its fully extended position 8 and its fully retracted position 7.

This is because the threshold electrical switch 58 is arranged as a normally open and temporarily closable hydraulic pressure responsive threshold electrical switch in the electric circuit 60 and is directly pressure responsive to the increasing dynamic fluid pressure, i.e. up to a controlling predetermined threshold operating fluid pressure at which the threshold switch 58 is adjustably set to close such electrical circuit 60, existing in the power line 33 via the power line 50 of the cylinders 22 of the compacting mechanisms 21 of the compacting assembly 15, as the pistons 23 increasing extend along the stroke path 16 from the initial position 17 to the final position 18.

Generally, the adjustably set predetermined threshold operating fluid pressure, i.e. in power line 33 and power line 50, at which the threshold electrical switch 58 is temporarily actuated to close the electrical circuit 60 will be slightly below the predetermined maximum operating fluid pressure at which the packer control relief valve 43 is adjustably set to open to relieve the fluid pressure in power line 33, and in turn the predetermined maximum pressure at which the packer control relief valve 43 is temporarily actuated to relieve the pressure in power line 33 will be slightly below the predetermined maximum operating system fluid pressure at which the main safety control relief valve 35 is adjustably set to open to relieve the pressure fluid in main power supply line 33.

Threshold electrical switch 58, by analogy to the mechanically operating pressure relief valves 43 and 35, is normally automatically closed in direct response to hydraulic pressure sensed thereby in the hydraulic line 33 that it serves and only so long as the pressure in such line exceeds its predetermined threshold actuation pressure, after which the threshold electrical switch 58 again automatically opens the electrical circuit 60 as such hydraulic line pressure decreases below such predetermined threshold actuation pressure.

In effect, the threshold electrical switch 58 controls the operation of the compacting assembly 15, i.e. throughout the full extent of forward movement of the ejector device 6 to its fully retracted position 7, by controlling the maximum pressure at which the pistons 23 during each compacting cycle continue to extend from the cylinders 22 of the piston-cylinder mechanisms 21, i.e. between the limits of the limit switches 63 and 64 at the ends of travel of the stroke path 16 defined by the initial position 17 and the final position 18.

Thus, during each compacting cycle, when the compacting assembly 15 compacts refuse against the ejector panel 9 to the full extent permitted up to the controlling predetermined threshold operating fluid pressure in power line 33 as sensed by the pressure sensitive threshold electrical switch 58, the threshold switch will automatically close the electric circuit 60 for energizing the solenoid 61 of the dump valve 59, i.e. each time such controlling threshold pressure is reached during forward movement of the compacting assembly 15 toward its final position 18.

This will cause concordant incremental forward movement of the ejector device 6 automatically toward its retracted position 7 at controlled uniform or constant rate or speed corresponding to the dump valve discharge flow rate and only indirectly under the dynamic pressure of the fluid supplied to the compacting assembly 15. Hence, regardless of fluctuations in the compacting force on the refuse during this time, the otherwise hydraulically locked static pressure fluid is emptied at uniform or constant rate from the ejector device 6 via the branch line 41 through the dump valve 59 and the return line 57 back to the tank 29.

Such incremental steady rate forward movement of the ejector device 6 will continue until such dynamic pressure in the still forwardly moving compacting assembly 15 decreases to below the predetermined threshold pressure as controlled by the threshold electrical switch 58. Understandably, during this time, the level of the compacting force exerted on the refuse by the still continuously forwardly moving compacting assembly 15 will automatically be relieved, i.e, fluctuate, temporarily because the original longitudinal distance between the panel mechanism 19 and the ejector panel 9 will increase to the extent that the ejector device 6 moves forwardly at such dump valve controlled steady discharge flow rate toward its retracted position and thus linearly away from the compacting assembly 15, even though such forward movement of the ejector device 6 is in fact caused by the indirect exertion of such relieved level compacting force thereon.

At the point at which the retracting movement of the ejector device 6 causes a sufficient decrease in the dynamic pressure in the compacting assembly 15, i.e. to below the controlling predetermined threshold pressure, the threshold electrical switch 58 will automatically once more open the electrical circuit 60 and instantaneously deenergize the dump valve solenoid 61 for automatically closing the dump valve 59. This will permit automatically the continued full extent compacting forward movement of the compacting assembly 15 toward its final position 18 for uniform tight compacting of the refuse and maximum storage thereof in the container 2 to the fully retracted limit of the ejector device 6, i.e. up to retracted position 7.

It will be realized that the dump valve 59 is not directly pressure connected with the compacting assembly 15, inasmuch as the ejector device hydraulic circuit, constituted by branch lines 40 and 41 relative to power line 33 and return line 36, is individually and independently supplied directly with pressure fluid via the ejector device control valve 39, and in turn the compacting assembly hydraulic circuit, constituted by branch lines 49 and 50 relative to power line 33 and return line 44, is individually and independently supplied directly with pressure fluid via the compacting assembly control valve 48.

Hence, the electrically operated dump valve 59 will relieve the ejector device 6 of hydraulic fluid in direct relation to the force of the refuse acting operatively thereagainst via the ejector panel 9 and only indirectly in relation to the hydraulic pressure in the power line 33 as sensed by the threshold electric switch 58.

On the other hand, while the force of the refuse will be registered differently against the ejector device 6 depending on the number and relative positions of the progressively sized individual stages or sections of the ejector device 6 and be modified somewhat by the sheer weight and friction of the mass of intervening already compacted refuse relative to the walls of the container 2, the threshold electric switch 58 will sense the compacting pressure in power line 33 directly and accurately for precise and instantaneous response for directly electrically controlling the opening and closing of the constant discharge flow rate dump valve 59 independently of the number and relative positions of the progressively sized individual stages or sections of the ejector device 6 and of the weight and friction of the refuse.

Moreover, since the dump valve 59 is not directly pressure connected with the compacting assembly 15 as might otherwise exist in conventional control systems, the operation of the dump valve 59 according to the present invention will not be subjected to hydraulic spikes and deadheaded cylinder pressure existing in the hydraulic circuit of the compacting assembly 15, as where the pistons 23 reach their limits relative to the amplitude of the stroke path 16. This would cause the undesired operation of such an otherwise so directly pressure connected dump valve or relief valve in such a conventional control system, and as a result the ejector device would be adversely retracted under the inherently self-expanding stored forces in the previously compacted refuse acting unilaterally thereon.

More specifically, since under such conventional conditions the deadheaded compacting assembly would exert no force dynamically on the refuse, the stored forces in the refuse would alone cause the retraction of the ejector device in uncontrolled manner, while the direct pressure operated dump valve or relief valve remained open consequent such pressure spike or deadheaded cylinder pressure. Hence, the refuse would become non-uniformly uncompacted randomly along its extent, redistributing itself against the freely yielding ejector device. This would not be remedied by the next compacting cycle since generally the compacting assembly can only efficiently exert its force incrementally locally on that refuse portion within its stroke amplitude, and such would not be sufficient to recompact uniformly the remote randomly expanded refuse portions.

For the same reason, the amplitude limiting switch means 62 are advantageously provided in relation to the hydraulic pressure responsive threshold switch means 58.

Specifically, the normally closed limit switches 63 and 64 are arranged in the electrical circuit 60, e.g. as cam activated micro switches, and selectively positioned adjacent to the stroke path 16 for operative activation by the pistons 23, e.g. via cams stationarily carried on their outer or exposed ends, for opening the switch means 62 to limit the electrical energization of the dump valve 59 to the amplitude or effective operational range of movement of the pistons 23 between the initial position 17 and final position 18 of the compacting assembly 15, and thus in that sense independently of the hydraulic pressure existing in the hydraulic control circuit of the compacting assembly 15 and in turn independently of that pressure as sensed by the threshold electrical switch 58.

Of course, the retracted limit switch 64, analogously to the extended limit switch 63, prevents deadheaded cylinder pressure in the retracting direction of the pistons 23 from causing the threshold switch 58 from operating the dump valve 59 for the same reason. On the other hand, while the refuse will be relieved of the force of the panel mechanism 19 when the compacting assembly 15 returns to its initial position 17, only local self-expansion of the already compacted refuse will occur in the vicinity of the panel mechanism 19, but not remotely therefrom since the ejector device 6 will be hydraulically locked during this time. Hence, upon the next compacting cycle, the dynamic force of the pistons 23 will be immediately effective for recompacting such locally expanded refuse portion thereat while it compacts the next successive refuse portion incrementally thereagainst in the normal manner.

As a result, the threshold electrical switch 58 will only function within the limits of the stroke path 16 as selected by the positioning of the limit switches 63 and 64, i.e. at the ends of such path as represented by the positions 17 and 18, as the case may be, and thus prior to the extreme retracted and extended limits of the pistons 23 relative to the cylinders 22, whereby to preclude the adverse influence of hydraulic pressure spikes and deadheaded cylinder pressure on the desired operation of the threshold switch 58 and the dump valve 59, and in turn on the desired uniformity of the compacted refuse.

On the other hand, when the ejector device 6 which is normally hidden from view actually reaches its fully retracted position 7, and is no longer responsive to closing of the threshold electrical switch 58, so that the pistons 23 cannot complete their compacting cycle to their final position 18, appropriate relief valve actuation will signal audibly and/or visually or otherwise to the workmen in the usual way that container 2 is completely filled to maximum capacity with refuse.

FIG. 5 shows a control system 28 similar to that of FIG. 4, but from which the elements 51–54 have been omitted, and illustrating the use of only one set of limit switches 63 and 64, with all other elements being the same as in FIG. 4 and being assigned like reference numbers for the same corresponding elements, yet being shown in generally block diagram configuration for the purposes of clarity.

Since the commonly pressure fluid supplied piston-cylinder mechanisms 21 of the compacting assembly 15 will generally operate in unison, the use of only one set of limit switches 63 and 64 will generally suffice, such that the second set thereof as shown in FIG. 4 may be omitted as shown in FIG. 5 without diminishing the overall control provided by the contemplated remaining amplitude limiting switch means 62.

Also, since the former function played by the ejector relief valve 56 in conventional control systems, is rendered superfluous by the incorporation of the dump valve 59 by way of the present invention, the ejector relief valve 56 may be omitted or optionally included as a locally positioned adjustable safety relief valve in the ejector device hydraulic control circuit, e.g. set to operate at a higher pressure than the predetermined maximum threshold pressure of the threshold electrical switch 58, e.g. at a pressure comparable to that at which the packer relief valve 43 operates.

Accordingly, by way of the present invention, as shown clearly in FIG. 5, an electrohydraulic control system is provided which includes as elements in combination, a hydraulically activated pressure switch 58 in the compacting assembly hydraulic circuit, an electrically energizable dump valve 59 in the separate ejector device hydraulic circuit and controlled by the pressure switch 58, and amplitude limiting switch means 62, e.g. cam activated limit switches 63 and 64, for controlling the operation of the pressure switch 58 in relation to the effective operation of the compacting assembly 15, all connected in series in an electrical control circuit 60.

Essentially, the pressure switch 58 senses the actual hydraulic pressure which the packing cylinders or piston-cylinder mechanisms 21 feel as the compacting assembly 15 pushes the refuse into the container 2 against the ejector panel 9. The reaction of the pressure switch 58 to its preset threshold pressure response in turn controls the electrically energized hydraulic dump valve 59, allowing hydraulic fluid to flow at uniform rate therethrough from the hydraulically locked hydraulic circuit of the multistage telescopic cylinder ejector device 6 so as to permit the ejector panel 9 to retract at uniform rate under the force of the compacted refuse or garbage, as sensed by the pressure switch 58, i.e. installed in the hydraulic circuit of the packing cylinders or piston-cylinder mechanisms 21.

As a result, by allowing the ejector panel 9 to move forwardly, i.e. away from the also moving compacting assembly 15, only when the desired optimum high threshold pressure in the packing cylinders or piston-cylinder mechanisms 21 is sensed, and only within the effective range of operation of the pistons 23, a tight and accurate control over the automatic movement and speed of movement of the ejector panel 9 in a direction away from the still moving compacting assembly 15 is attained. Accordingly, a uniformly tight compacted refuse content will be progressively stored in the container 2.

In short, by inserting such a pressure switch 58 in the hydraulic line from the control valve 42 which feeds the packing and sweep jacks, i.e. the sweeper piston-cylinder mechanisms 25 and the packer piston-cylinder mechanisms 21, such pressure switch may be adjusted to close when the pressure in such line reaches a predetermined amount and thereby ground the solenoid 61 of the dump valve 59 in an electrical circuit 60, e.g. with the battery 65 of the ignition system of the refuse vehicle 1, so as to cause the dump valve 59 to open and allow fluid to flow from the telescopic cylinder ejector device 6 back to the tank 29, enabling the ejector panel 9 to move back towards the forward end 7 of the container 2 for packing more refuse into the vehicle 1, i.e. in uniform and tight manner and to the full extent of the potential longitudinal capacity of the container 2 as limited only by the fully retracted position 7 of the ejector device 6 in the vicinity of the forward end 5 of the container 2.

Indeed, such cycle will continue repeatedly, with the pressure switch turning on and off and correspondingly controlling the desired intermittent movement of the ejector panel in conjunction with the continuous movement of the compacting assembly within the limits of its stroke path, and insuring that the refuse will be tightly compressed and compacted in the vehicle throughout the loading operation, yet with the limit switch means 62 being placed at the corresponding end of the packer jack travel, e.g. limit switch 63 at final extended position 18, to cut off the pressure switch at this point, and thereby insure that the pressure switch operates only in response to sensed packing pressure or compacting pressure of the continuously moving compacting assembly pistons, and not hydraulic spikes and deadheaded cylinder pressure, and in turn that the ejector device retracts uniformly in controlled manner as well as independently of the number and relative positions of its progressively sized individual stages or sections and of refuse caused friction.

It will be appreciated that by way of the foregoing, the above mentioned objects and advantages of the present invention are accordingly achieved. Indeed, unlike the conventional arrangement in which the back pack valve or ejector relief valve 56 is directly pressure responsive to the compacting pressure in power line 50, including deadheaded cylinder pressure which causes discharge of fluid from the telescopic cylinder ejector device 6 when the packing pistons 23 can no longer forwardly move and which permits in turn continued forward movement of the ejector panel 9 under the inherent reserve self-expanding force in the refuse itself, in the instant apparatus arrangement the ejector device 6 and ejector panel 9 can only retract forwardly simultaneously with the forward movement of the piston 23. Hence, the refuse can never self-expand in non-uniform, spontaneous, locally unequalized and random manner, according to the present invention.

Of course, any compacting means, including any conjoint sweeping means and pushing means, may be utilized according to the present invention in place of the compacting assembly 15, auxiliary arrangement 24 and panel mechanism 19, and the orientation of the piston-cylinder mechanisms 21 and 24 may be longitidinally reversed and/or such mechanisms 21 and 24 may be replaced by only one such mechanism 21 and 24 rather than a pair of such mechanisms as shown herein. Moreover, such mechanisms 21 and 24 may each be located on the exterior or interior of the tailgate 10, as desired.

In fact, any appropriate means may be provided to constitute the resultant compacting assembly as herein contemplated, so long as it includes a power line for supplying hydraulic pressure fluid for accomplishing the desired stroke amplitude linear forward movement compacting and with which the instant threshold electrical switch may be operatively pressure connected for the disclosed purposes.

It will be appreciated that the foregoing specification and accompanying drawings are set forth by way of illustration and not limitation, and that various changes and modifications may be made therein without departing from the spirit and scope of the present invention which is to be limited solely by the scope of the appended claims.

What is claimed is:

1. Refuse storage and discharge apparatus comprising a longitudinal container having a rearward end defining an opening and a forward end containing a hydraulically actuated multistage telescopic cylinder device longitudinally relatively movable between a retracted position adjacent the forward end and an extended position generally spanning the distance between the forward and rearward ends, the device being adapted to be operatively connected to an ejector panel for moving the panel longitudinally rearwardly through the container from the vicinity of the forward end to the vicinity of the rearward end upon actuating the device from its retracted position to its extended position for discharging through the opening refuse store in the container rearwardly of the panel, a hydraulically actuated compacting piston-cylinder assembly disposed rearwardly of the opening and longitudinally relatively movable reciprocally along a stroke path having an amplitude defined between a rearward initial position generally rearwardly of the opening and a forward final position generally adjacent the opening, the assembly being adapted to be operatively connected to refuse pushing means for conveying successive refuse portions forwardly into the container and for increasingly compacting each such conveyed refuse portion forwardly against the ejector panel or against the cumulative previously compacted successive refuse portions situated between the pushing means and the ejector panel upon actuating the assembly to move the assembly along the stroke path from its initial position to its final position, and control means for individually controlling the actuation of the device and of the assembly, and including a device hydraulic fluid circuit, a device actuation control valve, a dump valve, an electric circuit, an assembly hydraulic fluid circuit, an assembly actuation control valve, a threshold electrical switch, and amplitude limiting switch means, the device fluid circuit being adapted to be connected to a pressure source of hydraulic fluid, and containing the device control valve arranged for independent operation to supply hydraulic fluid to the device for moving the device rearwardly to its extended position and to lock hydraulically the device operatively in its extended position under static hydraulic pressure and against discharge of such fluid therefrom and in turn against forward movement of the device toward its retracted position, and also containing the dump valve arranged as a normally closed electrically energizable dump valve in the electrical circuit for intermittent energization to open the dump valve, independently of the operation of the device control valve, for intermittent periods of time to discharge incremental amounts of the static pressure fluid from the device to permit in turn concordant incremental forward movement of the device toward its retracted position, the assembly fluid circuit being adapted to be connected to a pressure source of hydraulic fluid, and containing the assembly control valve arranged for independent operation to supply hydraulic fluid to the assembly for moving the assembly along its path forwardly from its initial position to its final position under an increasing dynamic fluid pressure up to a predetermined threshold operating fluid pressure and in turn for moving the assembly back to its initial position, and also containing the threshold switch arranged as a normally open and temporarily closable hydraulic pressure responsive threshold electrical switch in the electrical circuit for energizing the dump valve and operatively pressure connected to the assembly fluid circuit for sensing the pressure of the fluid supplied to the assembly and for automatically closing the threshold switch temporarily each time the predetermined threshold fluid pressure is reached during forward movement of the assembly toward its final position so as to energize the dump valve for incremental forward movement of the device automatically toward its retracted position under the dynamic pressure of the fluid supplied to the assembly until such pressure decreases to below the predetermined threshold fluid pressure and thereby permit continued optimum compacting forward movement of the assembly toward its final position, and the amplitude limiting switch means being arranged as normally closed switch means in the electrical circuit and selectively positioned adjacent the stroke path for operative actuation by the assembly for opening the switch means to limit the electrical energization of the dump valve to the amplitude between the initial position and final position of the assembly independently of the pressure sensed by the threshold switch.

2. Apparatus according to claim 1 wherein a device relief valve is contained in the device fluid circuit and an assembly relief valve is contained in the assembly fluid circuit for selectively limiting the maximum operating pressure permitted in each of said fluid circuits in excess of the predetermined threshold pressure.

3. Apparatus according to claim 1 wherein the amplitude limiting switch means include an initial position limiting switch at the initial position of the assembly and a final position limiting switch at the final position of the assembly, the two limiting switches, the threshold switch and the dump valve being operatively connected in series in the electrical circuit.

4. Apparatus according to claim 1 wherein the device fluid circuit and the assembly fluid circuit are individually connected to a common source of hydraulic fluid including a reservoir and a pump for supplying hydraulic fluid under selective pressure to the device control valve and to the assembly control valve.

5. Apparatus according to claim 1 wherein an ejector panel is operatively connected to the device in the container, a raisable tailgate having a refuse hopper is provided at the opening, and the assembly is operatively mounted on the tailgate, a hydraulically actuated sweeping piston-cylinder auxiliary arrangement and refuse pushing means being disposed in the tailgate in operative relation to the assembly for conjoint operation therewith for sweeping refuse loaded in the hopper into the container via the auxiliary arrangement and the pushing means and in turn compacting such refuse therein via the assembly and the pushing means.

6. Apparatus according to claim 5 wherein the container and tailgate are mounted on a vehicle.

7. Apparatus according to claim 1 wherein the amplitude limiting switch means, threshold switch and dump valve are operatively connected in series in the electrical circuit.

* * * * *